US005509165A

United States Patent [19]

Zigelboim et al.

[11] Patent Number: 5,509,165

[45] Date of Patent: Apr. 23, 1996

[54] PAINT ROLLER

[76] Inventors: Ilan Zigelboim; Virginia B. Hagan, both of 4955 NW. 82nd Ter., both of Lauderhill, Fla. 33351

[21] Appl. No.: 415,451

[22] Filed: Apr. 3, 1995

[51] Int. Cl.[6] ..... B05C 17/02

[52] U.S. Cl. ..... 15/230.11; 15/248.2; 492/13; 492/19

[58] Field of Search ..... 15/230.11, 248.2; 492/13, 14, 19

[56] References Cited

U.S. PATENT DOCUMENTS

| | | | |
|---|---|---|---|
| 217,950 | 7/1879 | Langdon | 492/13 |
| 850,317 | 4/1907 | Ridgely | 492/13 |
| 1,534,559 | 4/1925 | Yant | 492/13 |
| 1,551,260 | 8/1925 | Michaels | 492/13 |
| 2,684,497 | 7/1954 | Graham . | |
| 2,702,917 | 3/1955 | Lynden | 15/230.11 |
| 2,735,128 | 2/1956 | Adams . | |
| 2,778,050 | 1/1957 | Meinhardt | 15/248.2 |
| 2,811,733 | 11/1957 | Sloan | 15/230.11 |
| 3,592,239 | 7/1971 | Adler . | |
| 3,593,361 | 7/1971 | Welt | 15/230.11 |
| 3,604,046 | 9/1971 | Taylor | 15/230.11 |
| 3,714,674 | 2/1973 | Simoncioni | 15/230.11 |
| 3,745,624 | 7/1973 | Newman | 15/230.11 |
| 3,866,257 | 2/1975 | Cansdale, Sr. | 15/230.11 |
| 4,325,157 | 4/1982 | Balint et al. . | |
| 5,263,748 | 11/1993 | Carstensen . | |

FOREIGN PATENT DOCUMENTS

| | | | |
|---|---|---|---|
| 180520 | 12/1954 | Austria | 15/230.11 |
| 525941 | 7/1956 | Belgium . | |
| 1040947 | 10/1958 | Germany | 15/230.11 |
| 241595 | 10/1925 | United Kingdom | 15/230.11 |
| 823204 | 11/1959 | United Kingdom | 15/230.11 |
| 828727 | 2/1960 | United Kingdom | 15/230.11 |
| 2229382 | 9/1990 | United Kingdom | 15/230.11 |

*Primary Examiner*—Mark Spisich
*Attorney, Agent, or Firm*—Richard C. Litman

[57] ABSTRACT

A paint roller with a frame providing maximum support for a cylinder while allowing easy removal of a cover on the cylinder. The cylinder is about two feet long for indoor use and three feet long for outdoor use. Because of this extended length, which is relatively greater than that of existing paint rollers, the coverage provided by the paint roller is greatly increased and less labor is spent in painting. To support this greater length of the cylinder, support wheels are provided one per each foot of length along the cylinder and the frame attaches to the cylinder on both sides. In order to provide access for the removal of the cover of the cylinder, one side of the frame pivots away from the cylinder. The frame has an arm that is hinged and another arm that is split such that it has two semi-circular portions. When the hinged arm pivots, the split arm separates and the frame is removed from one end of the cylinder, thus allowing for easy removal of the cover. During use of the paint roller, the split arm and the hinge are covered by lock nuts so as to avoid the pivoting of the frame during painting. To remove the cover, the lock nuts are threadedly moved away from the split and the hinge, and an arm section is pivoted away from the cylinder.

12 Claims, 3 Drawing Sheets

PAINT ROLLER

BACKGROUND OF THE INVENTION

1. Field of the Invention

The present invention relates to a paint roller, specifically one having a cylinder of greater than normal length and including a support structure for the cylinder.

2. Description of the Prior Art

An impediment to producing paint rollers for covering a significant amount of area in a relatively short time is that the length of cylinders that can be made is constrained by critical support limitations. Uniformly-spaced wheels along the length of the cylinder have not been contemplated by the designers of previous paint rollers. Further, the additional support of a frame supporting both ends of a cylinder has resulted in a solution to the previously unsolved problem that the cover cannot be easily removed from the cylinder. The present hinge and lock nut system is not disclosed or even suggested in the prior art.

U.S. Pat. Nos. 2,684,497, issued Jul. 27, 1954, to S. F. Graham, 2,735,128, issued Feb. 21, 1956, to D. H. Adams, and 4,325,157, issued Apr. 20, 1982, to Peter Balint et al., disclose paint rollers with extensions and paint shields. Belgium Patent 525,941, issued Jul. 6, 1956, to A. Canouet, shows a paint roller with screw thread attachments. However, none of these paint rollers contemplates the instant invention in that the frame is attached to the cylinder on only one side and there is no support structure on the cylinder.

U.S. Pat. Nos. 3,592,239, issued Jul. 13, 1971, to Cyrus Adler, and 5,263,748, issued on Nov. 23, 1993, to Kenneth J. Carstensen, disclose pipe structures that are hinged and have couplings. Neither of these connections is similar to that of the instant invention.

U.S. Pat. No. 3,866,257, issued Feb. 18, 1975, to William H. Cansdale, Sr., discloses a paint roller with an adjustable handle and a pivotal socket connecting the frame to the handle. The frame of the Cansdale, Sr. patent does not contain structure that allows it to pivot away from the cylinder for cover removal. Further, the cylinder of this prior patent does not have wheels to support it, in contradistinction to the instant invention.

None of the above inventions and patents, taken either singly or in combination, is seen to describe the instant invention as claimed.

SUMMARY OF THE INVENTION

The present paint roller has a cylinder of a such a length that painting can be accomplished more quickly. This cylinder, because of its length, has a unique support structure. The cylinder has uniformly spaced wheels along its length and is supported on both of its ends by a tubular frame. To facilitate removal of a cover or nap from the cylinder, a frame portion can pivot away from the cylinder. The frame includes two parts that are hinged together and another two parts that are separated by a split. Further, lock nuts are provided on the frame which can be engaged over the hinge and the split to prevent the frame from pivoting during the use of the paint roller. To remove the cover, the lock nuts are moved away from the split and the hinge.

Accordingly, it is a principal object of the invention to provide a paint roller with an elongated cylinder for greater coverage relative to the time spent painting.

It is another object of the invention to provide support for the elongated cylinder by providing support wheels uniformly spaced along the length of the cylinder and by providing a frame that supports the cylinder on both ends.

It is a further object of the invention to provide means to pivot and separate the frame so that a cover can easily be removed from the cylinder.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
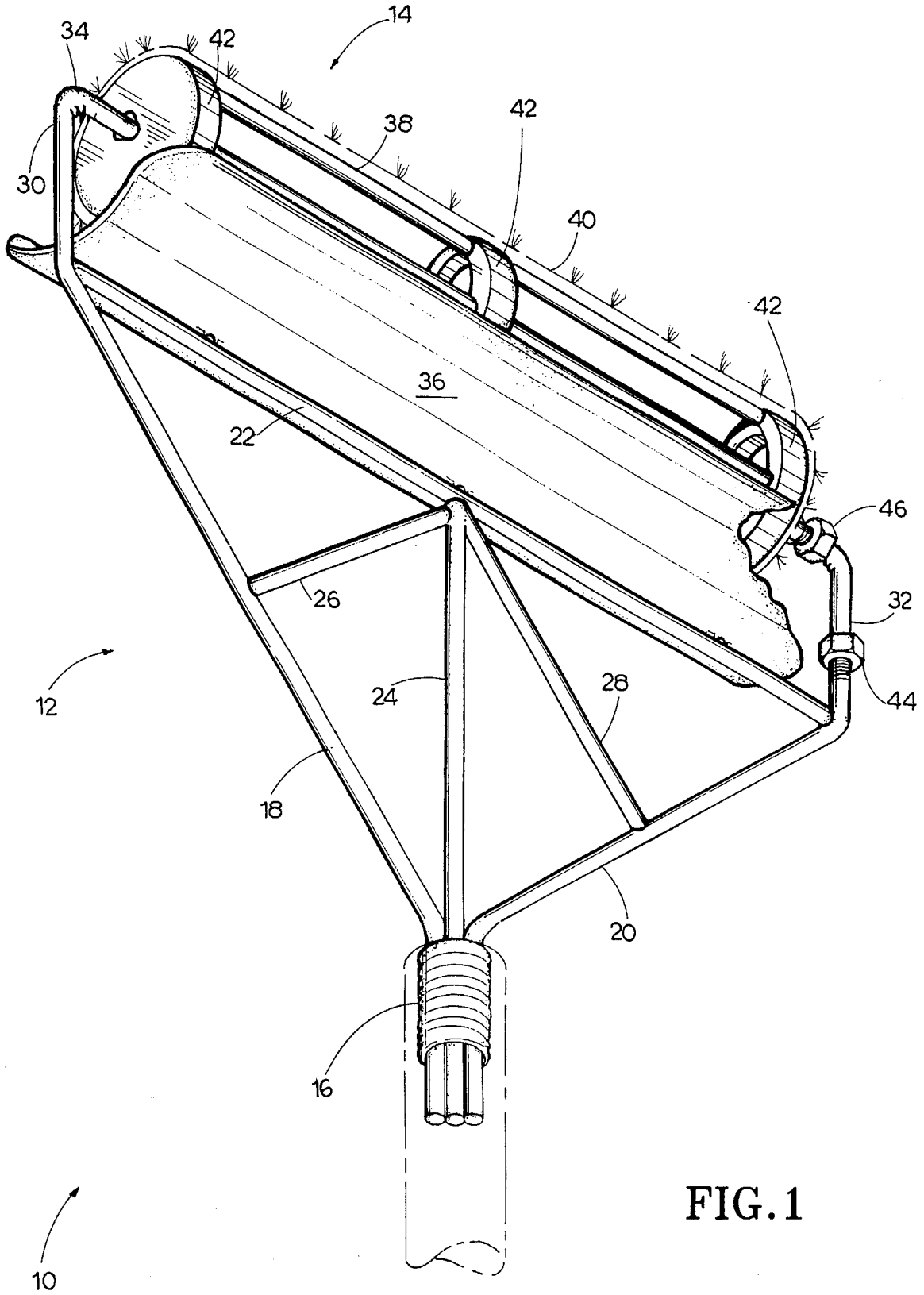
FIG. 1 is a fragmentary perspective of the paint roller with a shield partially cut away to show the right side of the frame.

The present invention relates to a paint roller 10 having a supportive frame 12, preferably tubular and made of aluminum or light steel, and a cylinder assembly 14 having integral support means, preferably uniformly-spaced wheels 42. The frame 12 can pivot away from the cylinder assembly 14 to allow for the easy removal of the cover 40 from the cylinder 38.

Figure 5:
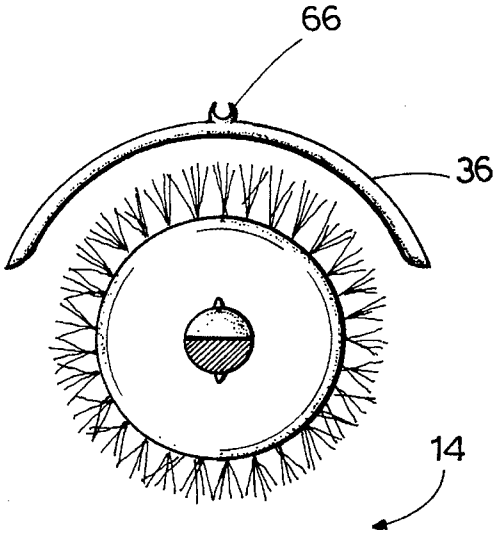
FIG. 5 is a side elevational view of the cylinder and shield.

The paint roller 10 is shown in its entirety in FIG. 1. The paint roller has an adapter 16 for fitting into an extension handle. The frame is of rugged construction and includes left and right bracing members 18 and 20 joined together by a horizontal base bar 22. A shield 36 may optionally be snapped onto the horizontal bar 22 with snaps 66 (shown best in FIG. 5). The frame 12 is further supported by vertical left and right support members 24, 26 and 28. Left and right arms 30 and 32 extend forwardly from the left and right bracing members 18 and 20 and are connected by a horizontal axle 34. The cylinder assembly 14 is rotatably mounted on the horizontal axle 34. The cylinder assembly 14 is longer than typical cylinder assemblies. For indoor use, the cylinder assembly 14 is, preferably, about two feet in length, and for outdoor use, it is, preferably, on the order of three feet in length. This additional length is supported by wheels 42 evenly spaced, preferably at one foot intervals, along the length of the cylinder assembly 14. Thus, the longer cylinder assembly receives the additional support of the wheels and the attachment of the frame 12 on both of its ends.

Figure 2:
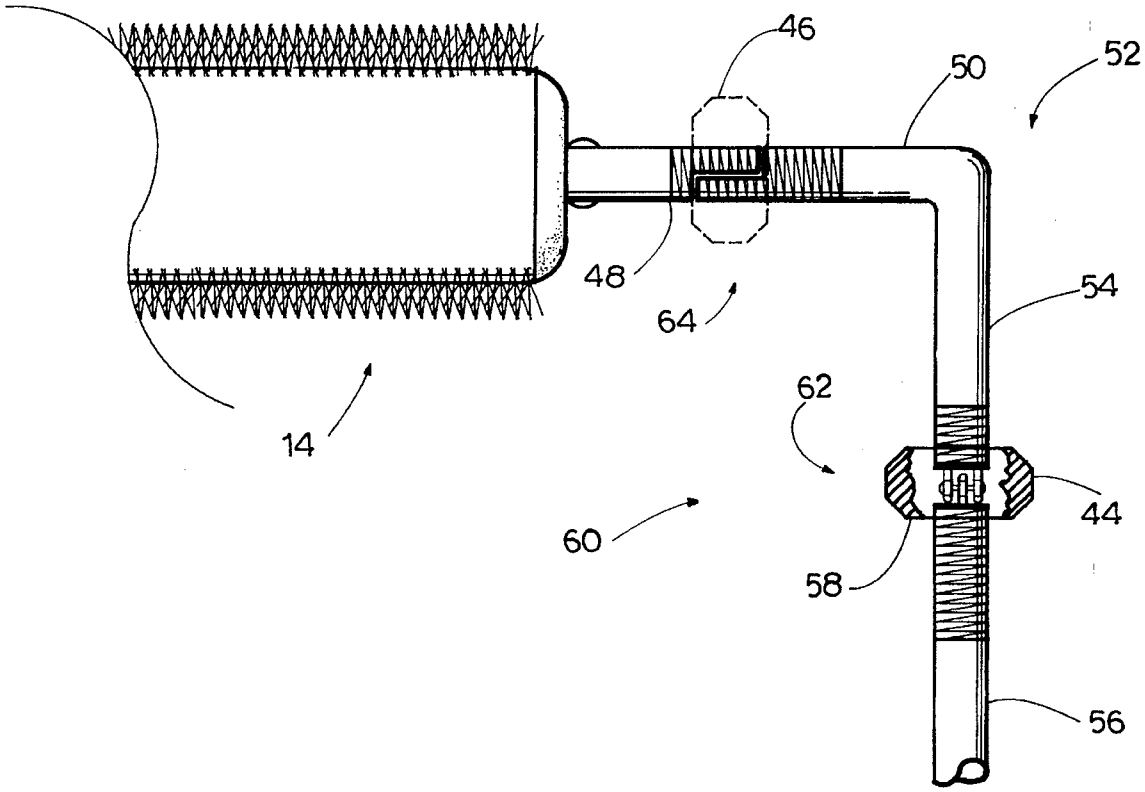
FIG. 2 is a fragmentary front elevational view of the paint roller showing the detail of the split member and the hinged connection.

To facilitate removal of the cover 40 from the cylinder assembly 14, the frame pivots and separates, allowing the cover 40 to be easily removed. This movement of the frame 12 can best be seen with reference to FIGS. 2, 3, 4A, and 4B. FIG. 2 shows the cylinder removal assembly 60. This assembly 60 allows an L-shaped part 52 of the frame 12 to pivot out of the plane of the cylinder assembly 14. The cylinder removal assembly 60 includes a swing hinge assembly 62 and an axle separation assembly 64. The swing hinge assembly 62 includes upper lower sections 54 and 56 of the right arm 32 of the frame attached by a hinge 58 and held together by a lock nut 44. The axle separation assembly 64 includes a left and a right section 48 and 50 of the axle 34. These two sections 48 and 50 are cut in half longitudinally to form two sections of semicircular cross-section, which mate to form a circular cross-section. These sections 48 and 50 form a split which is held together by a lock nut 46.

Figure 3:
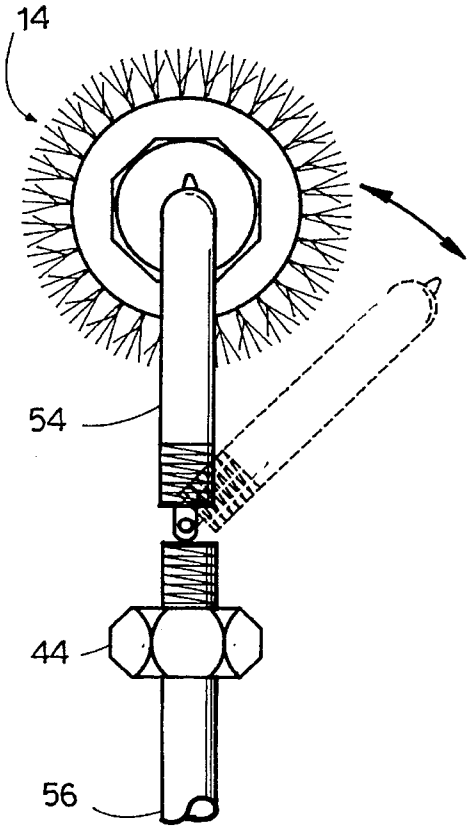
FIG. 3 is a side elevational view of the paint roller showing the pivotal motion.
Figure 4B:
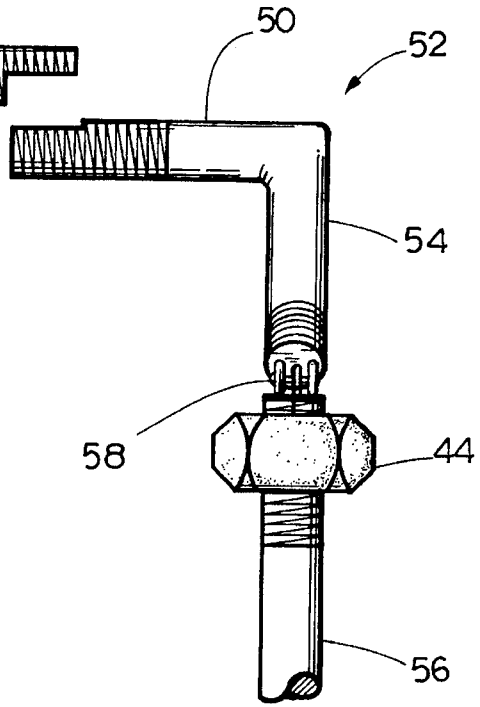
FIGS. 4A and 4B are fragmentary views of the paint roller similar to that in FIG. 2, the L-shaped member in FIG. 4B being shown in its pivoted position.
Figure 4A:
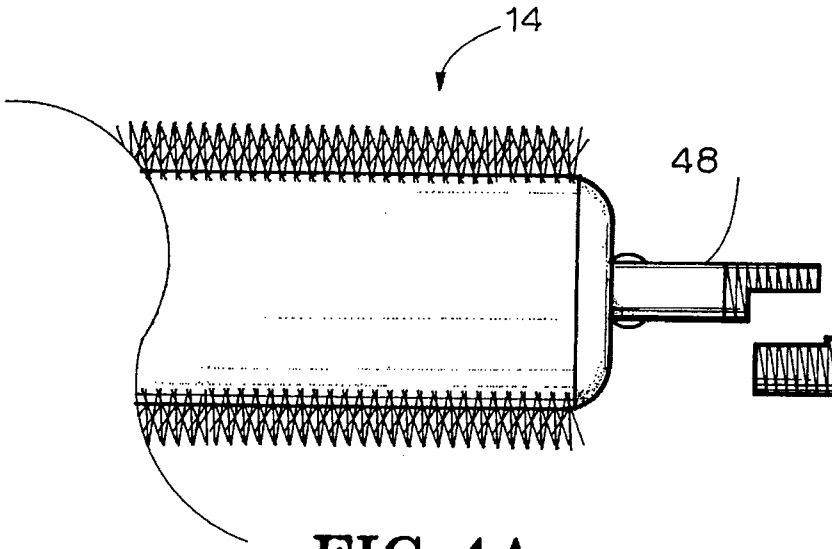

FIG. 2 shows the lock nuts 44 and 46 over the hinge and the split as in a painting position. In this position, the L-shaped assembly 52, which includes the right section 50 of the axle 34 and the upper section 54 of the right arm 32, is in the same plane as the rest of the frame 12. FIGS. 4A and 4B show the L-shaped assembly 52 pivoted so that the cover 40 can be removed from the cylinder assembly 14. To achieve this position, the lock nuts must be disengaged and moved away from the hinge and the split along the threads on the frame (lock nut 44 is shown screwed to a lower position). FIG. 3 shows a side view of the upper part 54 of the right arm 32 as it pivots.

It is to be understood that the present invention is not limited to the sole embodiment described above, but encompasses any and all embodiments within the scope of the following claims.

1. A paint roller comprising:

a frame; and a cylinder assembly having first and second sides at opposite ends thereof;

said frame supporting said cylinder assembly on both sides of said cylinder assembly;

said frame including:

a hinge assembly integral therewith for facilitating the removal of a cover from said cylinder assembly, said hinge assembly including a hinge that allows a frame portion to swing away from said cylinder assembly, and a lock nut threadedly movable along said frame to prevent said hinge from actuating.

2. The paint roller of claim 1, further including a split in said frame that separates when said frame portion is pivoted about said hinge.

3. The paint roller of claim 2, further comprising a second lock nut that is threadedly moved along said frame to prevent said frame from separating along said split.

4. The paint roller of claim 2, wherein said frame includes tubular components and said split includes two sections of said frame that have semicircular cross-sections at the point of connection with each other, said two sections mating with each other to form a cylinder of circular cross-section.

5. The paint roller of claim 4, further comprising a second lock nut that is threadedly moved along said frame to prevent said frame from separating along said split.

6. The paint roller of claim 4, wherein the cylinder assembly includes supports along its length.

7. The paint roller of claim 6 wherein said supports are wheels.

8. A paint roller comprising:

a frame; and a cylinder assembly having first and second sides at opposite ends thereof and including supports along its length;

said frame supporting said cylinder assembly on both sides of said cylinder assembly and including:

a hinge assembly including a hinge which allows a frame portion to swing away from said cylinder assembly;

a split in said frame that separates when said frame portion is pivoted about said hinge; and a lock nut that is threadedly moved along said frame portion to prevent said hinge from actuating.

9. The paint roller of claim 8, further comprising a second lock nut that is threadedly moved along said frame to prevent said frame from separating along said split.

10. The paint roller of claim 8 wherein said frame includes tubular components and said split includes two sections of said frame that have semicircular cross-sections at the point of connection with each other, said two sections mating with each other to form a cylinder of circular cross-section.

11. A paint roller comprising:

a frame having:

an adapter for fitting into a handle;

a left bracing member extending forwardly and leftwardly from said adapter;

a right bracing member extending forwardly and rightwardly from said adapter;

a horizontal armature attached to and extending between a front end of each said bracing member;

a support structure including;

a vertical support member extending from said adapter to a midpoint of said horizontal armature;

a left support member extending from a point at approximately a midpoint of said left bracing member to the midpoint of said horizontal armature;

a right support member extending from a point at approximately a midpoint of said right bracing member to the midpoint of said horizontal armature;

a left arm extending forwardly from the front end of said left bracing member;

a right arm extending forwardly from the front end of said right bracing member; and, a horizontal axle attached to and extending between a front end of each said arm;

a shield to capture paint splatter snapped onto said horizontal armature of said frame;

a cylinder assembly having a left and a right end including:

a cylinder rotatably mounted on said axle, said cylinder being oriented such that its longitudinal axis is in a horizontal orientation;

a removable cover covering said cylinder; and support wheels spaced along the length of said cylinder a cylinder removal assembly including:

a swing hinge assembly wherein said right arm includes two sections, each said section being threaded, said swing hinge assembly-including:

a lock nut threadedly engaging said two sections of said right arm; and a hinge that pivotally connects said two sections of said right arm; and an axle separation assembly, wherein the portion of said axle to the right of said cylinder includes two sections, said axle separation assembly including a lock nut threadedly engaging said two sections of said axle to the right of said cylinder;

whereby the forward section of the right arm and the right-most section of said axle form an L-shaped assembly, and the disengagement of each of said lock nuts allows said L-shaped assembly to pivot away from the rest of the frame and the cylinder.

12. The paint roller of claim 11 wherein said two sections of said axle each have a semicircular cross-section at the point of connection with each other, said sections of said axle mating with each other to form a cylinder of circular cross-section.

* * * * *